United States Patent [19]

Murkowski

[11] 4,324,357

[45] Apr. 13, 1982

[54] CARTON WITH AIR CUSHION END STRUCTURE

[75] Inventor: Rita J. Murkowski, Columbia, S.C.

[73] Assignee: The Continental Group, Inc., New York, N.Y.

[21] Appl. No.: 4,963

[22] Filed: Jan. 19, 1979

[51] Int. Cl.[3] ..... B65D 5/08; B65D 81/04

[52] U.S. Cl. ..... 229/37 E; 206/433; 206/591; 206/815; 220/416

[58] Field of Search ..... 206/433, 491, 521, 590-594; 220/416; 229/37 E, 39 B

[56] References Cited

U.S. PATENT DOCUMENTS

| | | | |
|---|---|---|---|
| 969,133 | 8/1910 | Cooper | 206/418 X |
| 1,284,817 | 11/1918 | Tinsley | 229/37 E |
| 1,619,608 | 3/1927 | Fairchild | 229/37 E |
| 1,747,979 | 2/1930 | Kondolf | 229/39 B |
| 2,448,401 | 8/1948 | Stone | 229/39 B |
| 2,531,090 | 11/1950 | Turner | 229/27 |
| 2,682,949 | 7/1954 | Whitehead | 229/27 |
| 2,745,617 | 5/1956 | Paige | 229/37 R X |
| 3,227,356 | 1/1966 | Eifrid | 229/37 E |
| 3,844,473 | 10/1974 | Whelan | 229/37 R X |

FOREIGN PATENT DOCUMENTS

| | | | |
|---|---|---|---|
| 199559 | 9/1958 | Austria | 229/39 B |

*Primary Examiner*—Stephen Marcus

*Attorney, Agent, or Firm*—Charles E. Brown

[57] ABSTRACT

A carton which is folded from a generally rectangular blank and which has at least one end structure which includes inner and outer end walls disposed in spaced relation and defining therebetween an air cushion so as to facilitate the shipping of fragile articles.

2 Claims, 7 Drawing Figures

CARTON WITH AIR CUSHION END STRUCTURE

This invention relates in general to new and useful improvements in cartons, and more particularly to cartons of the type normally formed from corrugated board.

While conventional carton structures suffice in most instances, there are certain products which should be packaged in a manner to be cushioned. It is also well known to provide suitable cushioning material to be placed within existing cartons. This invention most particularly relates to a carton which is so constructed wherein at least one end thereof includes an integral air cushion. Such a carton has been found suitable for preventing damage to items such as glass test tubes during shipment.

Cartons have been developed in the past for shipping articles such as glass test tubes. However, such cartons have been of a three-piece package arrangement which requires not only undue packing time, but more corrugated board in the forming of the overall carton.

In accordance with this invention a one-piece blank of a generally rectangular outline may be readily folded into a carton construction wherein at one end, or both ends if desired, there is a built-in air cushion. The air cushion is defined by a first pair of end wall members which are spaced inwardly of the carton body and define an inner end wall. The end structure also includes a second pair of end wall members which are located at the extreme end of the carton and define an outer end wall which is spaced from the inner end wall and wherein the desired air cushion is defined therebetween.

The first end wall members are connected to first side members of the carton body by spacer panels which provide for the desired inward recessing of the inner end wall. The second end wall members are directly carried by other side members of the carton body so as to provide for the automatic spacing of the two end walls.

In order to provide a supporting and spacing relation between the outer and inner end walls, the second end members carry second spacer members which are disposed in side-by-side relation and are arranged normal to the end walls.

The end structure further includes a pair of support panels which are carried by the second spacer panels and which are disposed in face-to-face engagement with the inner end wall.

The relationship of the first and second end wall members and their associated spacer and support panels is such that the free edges of the first end walls and the free edges of the spacer panels in the carton blank lie along a common plane, thereby providing for a maximum utilization of board.

With the above and other objects in view that will hereinafter appear, the nature of the invention will be more clearly understood by reference to the following detailed description, the appended claims, and the several views illustrated in the accompanying drawings.

IN THE DRAWINGS

Figure 7:
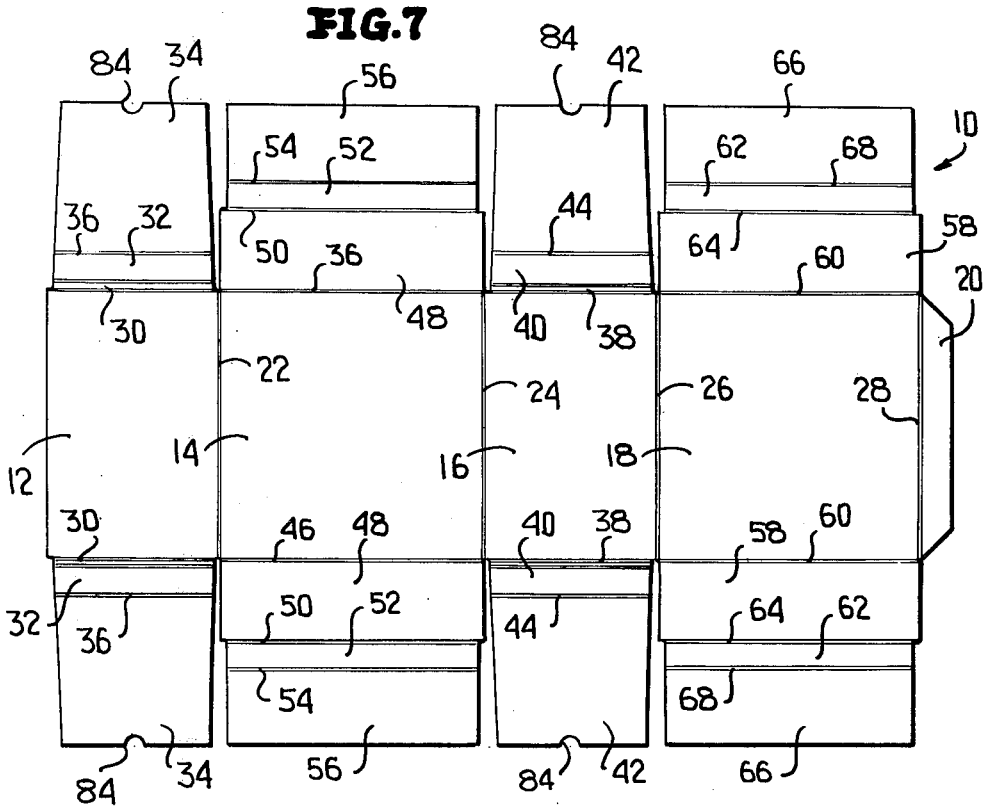
FIG. 7 is a plan view of a carton blank for forming the carton of FIG. 1 as viewed from the inner side thereof.

Referring now to the drawings in detail, reference is first made to the carton blank of FIG. 7 which is generally identified by the numeral 10. The carton blank is formed of board and preferably corrugated board and is of a generally rectangular configuration. The various members and panels are so arranged and configurated wherein there is a maximum utilization of the board.

The carton blank 10 includes a first body side member 12, a second body side member 14, a first body side member 16, a second body side member 18 and a closure flap 20, all of the same height or width transversely of the carton blank and joined together by fold lines. The fold lines include a fold line 22 between the members 12 and 14; a fold line 24 between the members 14 and 16; a fold line 26 between the members 16 and 18; and a fold line 28 between the member 18 and the flap 20.

Hingedly connected to opposite ends of the member 12 by means of a double fold 30 are spacer panels 32. Each spacer panel 32 carries a first end wall member 34 along a fold line 36 formed in the opposite surface of the blank 10. The same arrangement is carried by the member 16 and most specifically includes a double fold 38 connecting a spacer panel 40 to each end of the member 16. Each spacer panel 40 carries a first end wall member 42 by means of a fold line 44.

The side member 14 has hingedly connected at opposite edges thereof along fold lines 46 second end wall members 48. The second end wall members 48 carry along hinge lines 50 spacer panels 52 which, in turn, carry along fold lines 54 support panels 56. A like arrangement is carried at opposite ends of the side member 18 with there being a second end wall member 58 connected to each end of the member 18 along a fold line 60. A spacer panel 62 is connected to each second end wall member 58 along a fold line 64 and a support panel 66 is connected to a respective panel 62 along a fold line 68. At this time it is to be noted that each of the first end wall members and its associated spacer panel are of a tapered construction whereas each of the spacer panels and its respective support panel is stepped inwardly relative to its associated second end wall member. It is also to be noted that at each side of the carton blank 10, the free edges of the first end wall members and the adjacent support panels lie along a common plane.

It is particularly pointed out here that the construction of the carton blank 10 is such that a maximum board utilization is obtained from a rectangular board.

The carton blank 10, when assembled, forms a generally rectangular carton 70 having an air cushion at each end thereof as will be described hereinafter. In the formation of the carton 70 from the carton blank 10, the flap 20 is adhesively secured to the free edge portion of the side member 12. This may be accomplished at the time of forming the carton blank so that the carton may be supplied in a folded knocked-down state.

Figure 2:
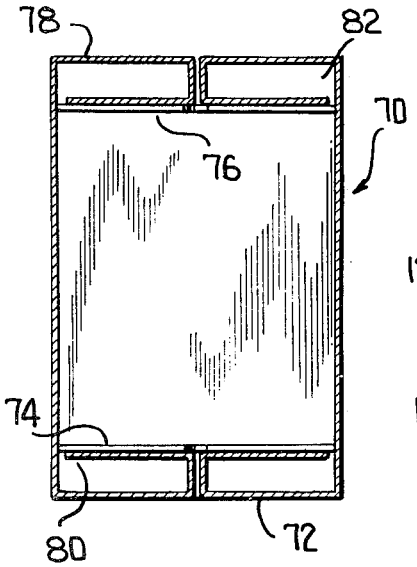
FIG. 2 is a transverse sectional view taken through the completed carton of FIG. 1, and shows the arrangement of the various walls and panels.
Figure 3:
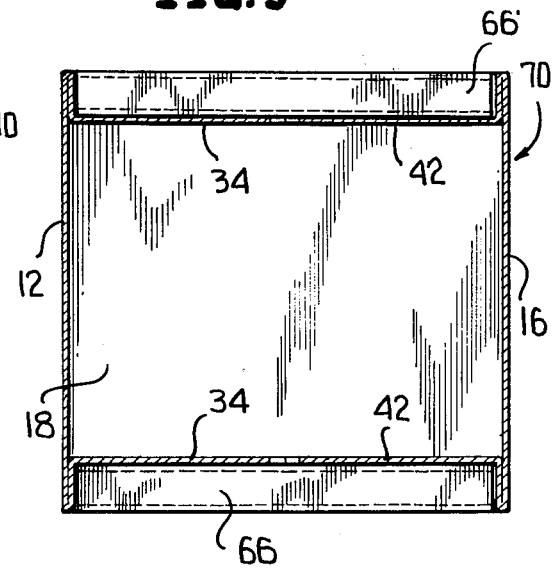
FIG. 3 is a longitudinal vertical sectional view taken through the completed carton of FIG. 1, and further shows the arrangement of the walls and panels.
Figure 4:
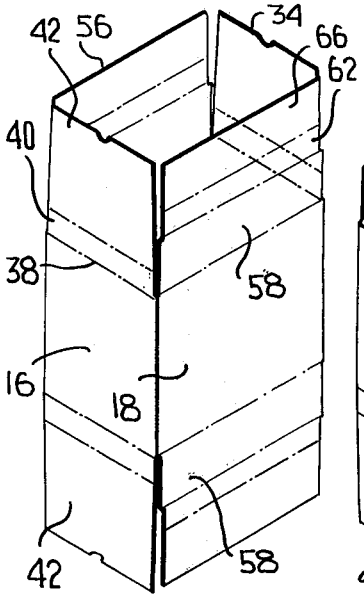
FIGS. 4, 5 and 6 are perspective views showing the manner in which the various walls and panels are folded to form one of the end structures.
Figure 5:
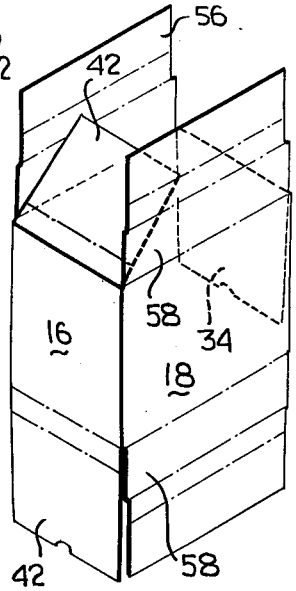
Figure 6:
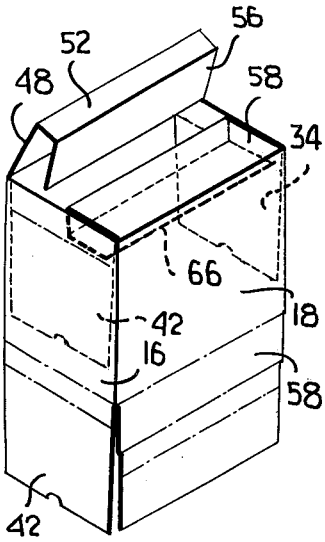

The carton is first opened to a tubular form, as shown in FIG. 4, and then the first end wall members 34 and 42 and their associated spacer panels 32 and 40, respectively, are folded down into the body of the carton alongside the respective side members 12 and 16 along the double folds 30 and 38 as shown in FIG. 5. Then the second end wall members 48 and 58 are folded in place, preferably after the respective spacer panels and support panels are folded relative thereto, so that the support panels lie parallel to and in spaced relation to the respective second end wall members. When properly folded in place, the second end wall members 48 and 58 lie in a common plane and define an outer end wall 72, as shown in FIGS. 2 and 3. The folding of the second end wall members and their respective spacer and support panels is best shown in FIG. 6.

After the one end structure of the carton 70 has been partially folded, the carton is inverted and the first end wall panels 34 and 42 are folded towards the support panels 56 and 66 along the respective fold lines 36 and 44 to lie in a common plane and to define an inner end wall 74. It is to be understood that the end wall members 48 and 58 forming the end wall 72 are joined together by means of a tape (not shown) overlying the adjacent ends thereof and joining the ends together.

Figure 1:
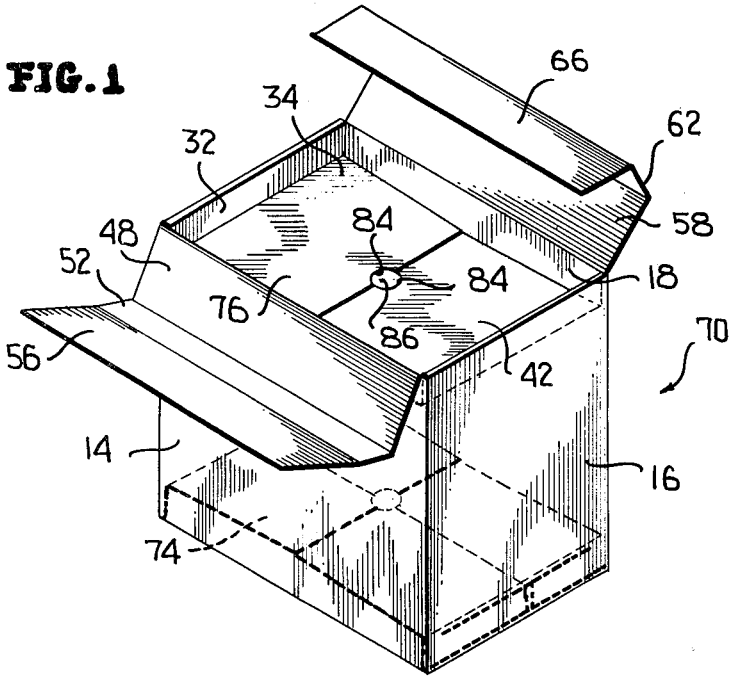
FIG. 1 is a top perspective view of the carton in a completed state with the exception of the second end walls and their associated support and spacer panels being folded into place.

With the carton 70 so erected, the articles to be packaged therein may now be placed into the carton and the then top end structure may now be completed. This is accomplished by folding the spacer panels 32, 40 and the end wall members 34, 42 within the upper part of the carton as shown in FIG. 1, followed by the folding of the remaining end wall members 48, 58 and their associated spacer panels 52, 62 and support panels 56, 66 into the upper part of the carton as generally initiated in FIG. 1 and shown in FIGS. 2 and 3. A second tape (not shown) is then applied across the joint between the end wall members 48, 58 to complete the carton.

At the top of the carton 70, the first end wall members 34, 42 form a second inner end wall 76 while the second end wall members 48, 58 form a second outer end wall 78. It will be readily apparent that disposed between each pair of end walls is a space which is filled with air and that the space defines an air cushion. The lower air cushion is defined by the numeral 80 and the upper air cushion is defined by the numeral 82.

It is to be understood that while normally both air cushions 80 and 82 are desired, in certain instances, particularly where the cartons are not to be stacked, the air cushion 82 at the top of the carton could be eliminated and the carton may have conventional top closure panels or end wall members.

The tapering of the first end wall members 34, 42 facilitates their folding into the interior of the carton while the inward offsetting of the spacer panels 52, 62 and the support panels 56, 66 accommodates for the inwardly folded spacer panels 32, 40.

It is to be noted that the free edge or end of each of the first end wall members 34, 42 is provided with a notch 84. In the erected carton, a pair of notches 84 combine to define a finger opening 86 which facilitates the lifting of the respective first end wall members from their coplanar state.

A 37 CFR 1.60 continuation application directed to the blank per se was filed on Oct. 6, 1981.

Although only a preferred embodiment of the carton has been specifically illustrated and described herein, it is to be understood that minor variations may be made in the carton construction without departing from the spirit and scope of the invention as defined by the appended claims.

What is claimed as new is:

1. A carton end structure comprising a carton body including first and second pairs of side members, first end wall members carried by said first side members and recessed within said carton body and forming an inner end wall, second end wall members carried by said second side members and forming an outer end wall, said outer end wall being spaced from said inner end wall with there being an air cushion space between said inner and outer end walls, and spacer means between said inner wall and said outer wall for maintaining said inner and outer walls in said spaced relation, said spacer means being carried by said second end wall members and including a spacer panel carried by each second end wall member remote from said second side members, said spacer panels being arranged in side-by-side relation and being generally normal to said first and second end walls, and support panels carried by said spacer panels and bearing against said inner end wall.

2. The carton end structure of claim 1 wherein said support panels and said inner end wall are in face-to-face relation.

* * * * *